US005560808A

United States Patent [19]

Graf

[11] Patent Number: 5,560,808

[45] Date of Patent: Oct. 1, 1996

[54] HYDRAULICALLY ACTUATED BREAST ROLL SHAKE

[75] Inventor: Edwin X. Graf, Menasha, Wis.

[73] Assignee: Voith Sulzer Papiermaschinen GmbH, Heidenheim, Germany

[21] Appl. No.: 391,583

[22] Filed: Feb. 21, 1995

[51] Int. Cl.[6] ..... D21F 1/8

[52] U.S. Cl. ..... 162/209; 162/355; 162/262; 162/DIG. 11

[58] Field of Search ..... 162/355, 209, 162/262, DIG. 11, DIG. 10

[56] References Cited

U.S. PATENT DOCUMENTS 4,055,460 10/1977 Buchanan ..... 162/355

*Primary Examiner*—David L. Lacey
*Assistant Examiner*—Calvin Padgett
*Attorney, Agent, or Firm*—Taylor & Knuth, P.C.

[57] ABSTRACT

The invention is directed to a roll shake connected to a roll in a paper-making machine, wherein the roll is movable in a direction generally parallel to an axis of the roll. A first hydraulic ram assembly, including a first cylinder and a first ram reciprocally disposed in the first cylinder, is attached to the roll. A second hydraulic ram assembly, including a second cylinder and a second ram reciprocally disposed in the second cylinder, is rigidly connected to the first cylinder. A counter mass is connected to the second ram, and is movable in a direction generally parallel to the roll axis. A controller is connected to the first hydraulic ram assembly and the second hydraulic ram assembly. The controller independently controls reciprocating movements of the first ram and the second ram within the first cylinder and the second cylinder, respectively, whereby a resultant momentum of the roll and the counter mass is approximately equal to zero at any point in time.

22 Claims, 2 Drawing Sheets

HYDRAULICALLY ACTUATED BREAST ROLL SHAKE

BACKGROUND OF THE INVENTION

1. Field of the invention

The present invention relates to a breast roll shake for use in a paper-making machine, and, more particularly, to a vibration compensated breast roll shake for use in a paper-making machine.

2. Description of the related art

A paper-making machine typically includes a headbox having an outlet from which is discharged a fiber suspension having a substantially constant cross-section across the width of the paper-making machine. The fiber suspension is guided onto an endless fabric or "wire" belt which is carried by a so-called breast roll. In such a machine, it is known to move the breast roll in reciprocating fashion in a direction parallel to the longitudinal axis of the breast roll. Such movement of the breast roll imparts a fluid shear in the fiber suspension carried on the wire belt and prevents flocculation of the fiber suspension while a paper web is being formed by dewatering of the fiber suspension. One known method of moving the breast roll is to use a so-called breast roll shake having a rotatable crank shaft attached to a connecting rod. The connecting rod interconnects one end of the breast roll with the crank shaft. Rotation of the crank shaft causes the arm to move the breast roll in reciprocating fashion in a longitudinal direction thereof. The breast roll is attached to a fiberglass mounting which allows the reciprocating movement thereof.

A problem with conventional breast roll shakes is that at least a portion of the forces transmitted to the breast roll by the breast roll shake are also transmitted to the mountings which hold the breast roll shake unit to a fixed surface. Since a breast roll can weigh about 21,000 pounds or even larger, the force which is exerted on the mountings of the breast roll shake unit can likewise be large, resulting in fatigue failure thereof.

Another problem with known breast roll shakes is that the cam shaft operates at a particular rotational speed, resulting in a breast roll having a velocity profile curve which is substantially sinusoidal. With known breast roll shakes, it is not possible to change the velocity profile curve of the breast roll reciprocating movements (other than amplitude and frequency).

What is needed in the art is a breast roll shake which offsets the momentum of the moving breast roll, thereby substantially eliminating fatigue stress on the mounting between the breast roll shake and fixed surface.

What is further needed in the art is a breast roll shake which moves the breast roll such that different velocity profile curves thereof may be realized.

SUMMARY OF THE INVENTION

The present invention provides a breast roll shake having two hydraulic ram assemblies. A ram of one hydraulic assembly is connected to and moves the breast roll, and a ram of the other hydraulic assembly is connected to and moves a counter mass. A controller reciprocates the rams within respective cylinders of the hydraulic assemblies such that a resultant momentum of zero occurs between the breast roll movements and the counter mass movements.

The invention comprises, in one form thereof, a roll shake for connection to a roll in a paper-making machine, wherein the roll is movable in a direction generally parallel to an axis of the roll. A first hydraulic ram assembly, including a first cylinder and a first ram reciprocally disposed in the first cylinder, is attachable to the roll. A second hydraulic ram assembly, including a second cylinder and a second ram reciprocally disposed ill the second cylinder, is rigidly connected to the first cylinder. A counter mass is connected to the second ram, and is movable in a direction generally parallel to the roll axis. A controller is connected to the first hydraulic ram assembly and the second hydraulic ram assembly. The controller independently controls reciprocating movements of the first ram and the second ram within the first cylinder and the second cylinder, respectively, whereby a resultant momentum of the roll and the counter mass is approximately equal to zero at any point in time.

An advantage of the present invention is that the momentum of the breast roll movements is offset by the momentum of the counter mass movements.

Another advantage is that the velocity profile curve of the breast roll movements can be changed from a sinusoidal profile curve to another desired, profile curve, such as a stepped profile curve or ramp profile curve.

Yet another advantage is that the weight of the fiber suspension on the breast roll is accommodated when controlling the two hydraulic rams, thereby resulting in a more accurate conservation of momentum between the moving breast roll and moving counter mass.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
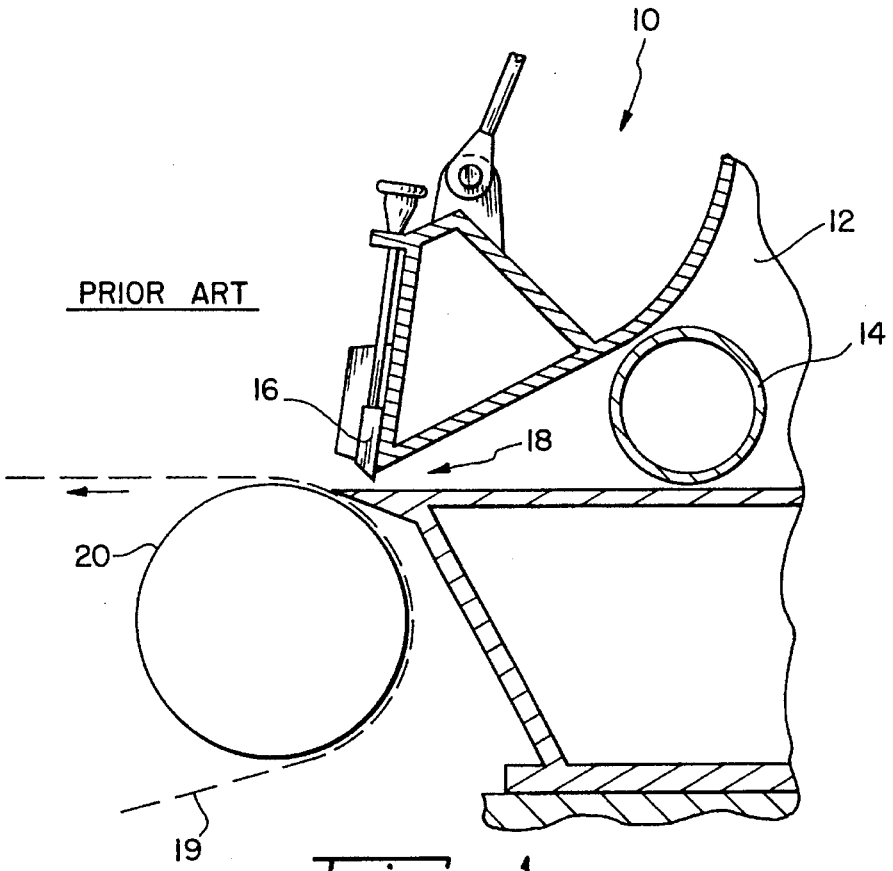
FIG. 1 is a fragmentary, perspective view of a headbox and a breast roll with which the present invention may be utilized.

Referring now to the drawings and particularly to FIG. 1, there is shown a fragmentary, perspective view of a headbox 10 with which the present invention may be utilized. A headbox 10 includes a main chamber 12 in which is disposed a distributor roll 14. A slice lip 16 is disposed adjacent to outlet 18, from which fiber suspension is discharged. The fiber suspension is discharged onto a wire belt 19 carried by a breast roll 20. For details of such a headbox, reference is made to U.S. Pat. No. 5,277,765 (Graf), which is assigned to the assignee of the present invention and incorporated herein by reference.

Figure 2:
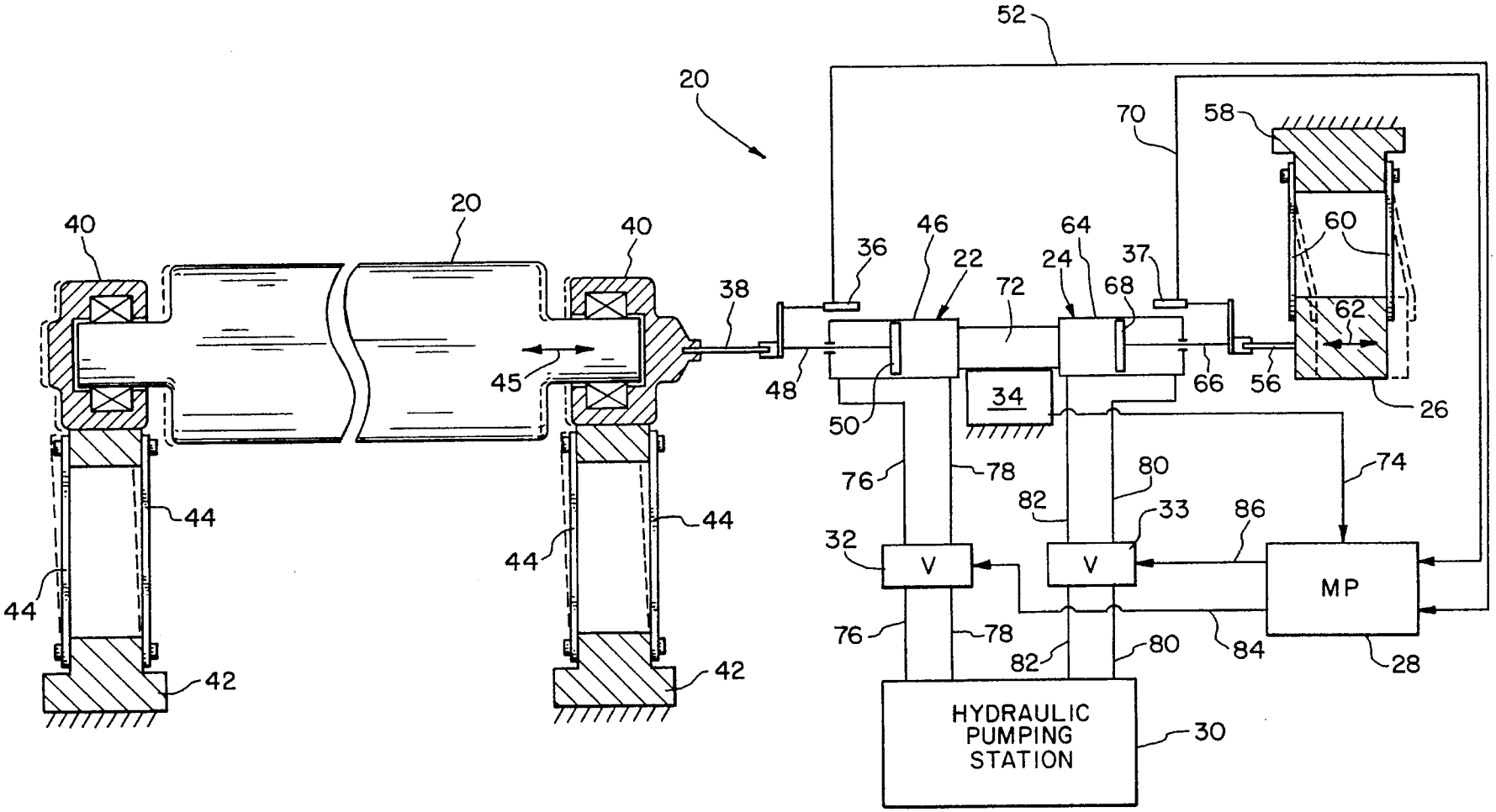
FIG. 2 is a schematic drawing of one embodiment of the breast roll shake of the present invention, attached to the breast roll shown in FIG. 1.

According to the present invention, and referring now to FIG. 2, an embodiment of a breast roll shake 20 of the present invention is shown. In general, breast roll shake 20 includes a first hydraulic ram assembly 22, a second hydraulic ram assembly 24, a counter mass 26, and a controller including a microprocessor (MP) 28, hydraulic pumping station 30, hydraulic servo-valves (V) 32, 33, load cell 34 and displacement transducers 36, 37.

Where any form of the term "control" is used in this application, such as "control", "controller" or "controlling", it is to be understood that the term "control" includes the meaning of the word "regulation". That is, such "control" may or may not include a feedback loop.

Breast roll 20 is connected to first hydraulic ram assembly 22 via arm 38. Breast roll 20 is rotatably carried within bearing mounts 40, which are in turn connected to a fixed surface 42 via fiberglass springs 44. Fiberglass springs 44 allow a limited side-two-side movement of breast roll 20 in a longitudinal direction thereof as indicated by directional arrow 45. The dashed lines indicate a position of breast roll 20, bearing mounts 40 and fiberglass springs 44 when moved to the left by arm 38.

First hydraulic ram assembly 22 includes a first cylinder 46 and a first ram 48 attached to a first piston 50. First hydraulic ram assembly 22 is a two-way assembly, meaning that first piston 50 can be driven in either direction within first cylinder 46. First ram 48 and first piston 50 are reciprocally disposed within first cylinder 46. First ram 48 is connectable to breast roll 20 via arm 38. Attached to a distal end of first ram 48 is displacement transducer 36, which is electrically connected to microprocessor 28 via line 52. In the embodiment shown, displacement transducer 36 is an inductive proximity sensor. However, other displacement transducers, such as a linearly variable differential transformer (LVDT) could be utilized. Displacement transducer 36 provides a plurality of signals to microprocessor 28 via line 52 indicating reciprocal movements of first ram 48 and first piston 50 within first cylinder 46.

Counter mass 26 is connected to second hydraulic assembly 24 via arm 56. Counter mass 26 is also connected to fixed surface 58 via fiberglass springs 60. Fiberglass springs 60 allow side-to-side movement of counter mass 26 in a direction generally parallel to directional arrow 45, as indicated by directional arrow 62. Fiberglass springs 60 may allow side-to-side movements of counter mass 26 which are greater than that of the side-to-side movements of breast roll 20, as will be discussed infra. In the embodiment shown, counter mass 26 has a weight which is about one-tenth of the weight of breast roll 20.

Second hydraulic ram assembly 24 includes a second cylinder 64 and a second ram 66 attached to a second piston 68. Second hydraulic ram assembly 24 is a two-way assembly, meaning that second piston 68 can be driven in either direction within second cylinder 64. Second ram 66 and second piston 68 are reciprocally disposed within second cylinder 64. Second ram 66 is connected to counter mass 26 via arm 56. Attached to a distal end of first ram 66 is displacement transducer 37, which is electrically connected to microprocessor 28 via line 70. In the embodiment shown, displacement transducer 37 is an inductive proximity sensor. However, other displacement transducers, such as a linearly variable differential transformer (LVDT) could be utilized. Displacement transducer 37 provides a plurality of signals to microprocessor 28 via line 70 indicative of reciprocal movements of second ram 66 and second piston 68 within second cylinder 64.

First hydraulic rata assembly 22 and second ram hydraulic assembly 24 are rigidly connected together via a coupling 72. It is to be understood, however, that first cylinder 46 and second cylinder 64 could be formed from a single cylinder having a dividing wall therein. Load cell 34 is attached directly to coupling 72 and senses a force applied thereto in a direction generally parallel to directional arrow 45 (i.e., along the longitudinal axis of first ram 48 and second ram 66). Load cell 34 is connected to microprocessor 28 via line 74 and provides a plurality of signals to microprocessor 28 indicative of the forces detected by load cell 34.

Hydraulic pumping station 30 is fluidly connected to each of first hydraulic assembly 22 and second hydraulic assembly 24 via fluid lines 76, 78 and 80, 82, respectively. Servo-valve 32 controls the flow of fluid through fluid lines 76, 78; and servo-valve 33 controls the flow of fluid through fluid lines 80, 82. Servo-valves 32, 33 are connected to microprocessor 28 via lines 84, 86. Microprocessor 28 controls servo-valves 32, 33 to effect a two-way fluid flow through fluid lines 76, 78 and 80, 82, respectively. The control of servo-valves 32, 33 is dependent upon the input signals received via lines 52, 70 and 74.

In operation, microprocessor 28 actuates servo-valve 32 to effect movement of first ram 48 within first cylinder 46, which in turn effects movement of breast roll 20. Displacement transducer 36 provides input signals to microprocessor 28 indicative of the displacement of first ram 48 within first cylinder 46. Additionally, load cell 34 also provides a plurality of signals to microprocessor 28 via line 74 indicating a load placed thereon. Displacement signals received by microprocessor 28 from displacement transducer 36 can be differentiated in known fashion to provide a plurality of corresponding velocity signals. Valve 32 is further actuated by microprocessor 28, dependent on the velocity signals, to effect a particular selected velocity profile curve for first ram 48 and breast roll 20.

At the same time, displacement transducer 37 is also providing an input signal to microprocessor 28 indicative of the displacement of second ram 66. The displacement signal provided by displacement transducer 37 can likewise be differentiated to provide an indication of the velocity of second ram 66. As is known, the momentum of a body is a function of the mass and velocity of the body. Accordingly, since the velocity of first ram 48 is known, and since the mass of each of breast roll 20 and counter mass 26 are known, it is possible to calculate using microprocessor 28 a velocity at which second ram 66 must travel in a direction opposite to first ram 48 such that a conservation of momentum occurs between breast roll 20 and counter mass 26 (i.e., a resultant momentum of approximately zero occurs between breast roll 20 and counter mass 26). The clock cycles of microprocessor 28 can be used to (de)actuate servo-valves 32, 33 at particular points in time.

Concurrently with the signals being transmitted to microprocessor 28 via displacement transducer 36, 37, load cell 34 also provides input signals to microprocessor 28 indicative of loads placed thereon. These signals can be utilized by microprocessor 28 to actuate servo-valve 33 such that a zero load condition occurs. For example, it is possible to change the cross-sectional area of outlet 18 of headbox 10 and thereby change the mass of the fiber suspension which is deposited onto breast roll 20. A change in the fiber suspension mass, i.e., basis weight, which is deposited onto breast roll 20 changes the "effective" mass of breast roll 20. Since the momentum of breast roll 20 is a function of both the mass and velocity thereof, a change in the effective mass of breast roll 20 by changing the fiber suspension mass in turn changes the momentum of breast roll 20. Load cell 34 detects forces exerted thereon which may be caused, e.g., by a change in profile weight. Load cell 34 therefore provides real-time adjustment to the calculated velocity at which second ram 66 is driven.

It is apparent from the above description of operation that if counter mass 26 is lighter than breast roll 28, second ram 66 and counter mass 26 will be moving at a greater velocity than first ram 48. This in turn means that the distance traveled by second ram 66 is greater than the distance traveled by first ram 48, and likewise means that the distance traveled by counter mass 26 is greater than the distance traveled by breast roll 20. In the embodiment shown in the drawings, breast roll 20 has a weight of about 21,000 pounds and moves a distance of 0.5 inch, and counter mass 26 has a weight of about 2,100 pounds and moves a distance of about 5 inches.

Figure 3:
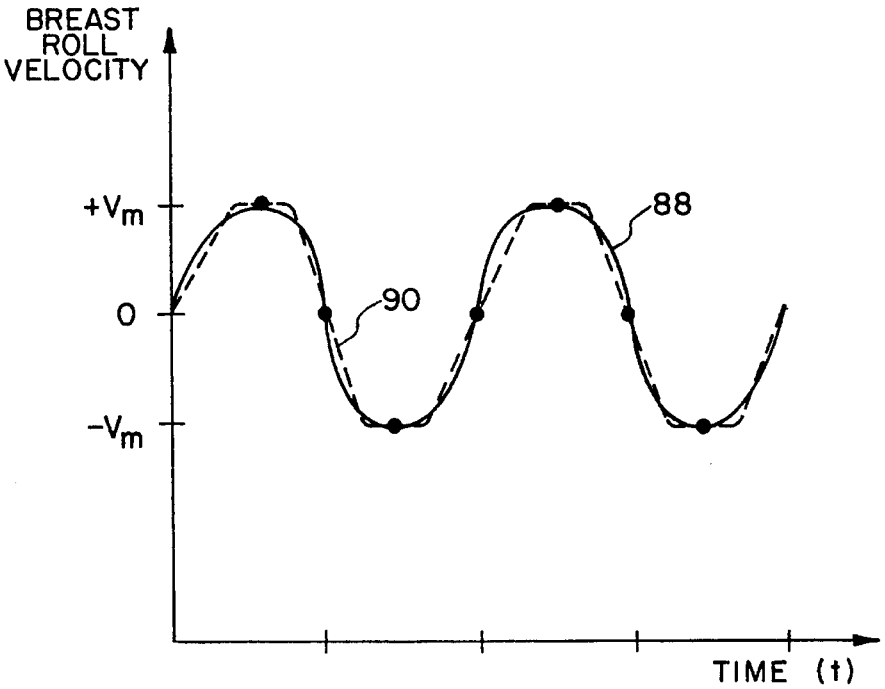
FIG. 3 is a graphical representation of examples of breast roll velocity profile curves which may be attained using the breast roll shake of FIG. 2.

Referring to FIG. 3, two possible velocity profile curves for breast roll 20 are shown. The sinusoidal curve represented by solid line 88 corresponds to a velocity profile curve which occurs with a conventional breast roll shake, and is likewise possible with the present invention. Additionally, a ramp function velocity profile curve represented by dashed line 90 is also possible with the present invention. Other velocity profile curves, such as a square wave or step function profile curve are also possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of moving a roll on a paper-making machine in a direction generally parallel to the longitudinal axis of the roll, comprising the steps of:

providing a first hydraulic ram assembly, including a first cylinder and a first ram reciprocally disposed in said first cylinder, said first ram attached to the roll;

providing a second hydraulic ram assembly, including a second cylinder and a second ram reciprocally disposed in said second cylinder, said second cylinder being rigidly connected to said first cylinder;

providing a counter mass connected to said second ram, said counter mass movable in a direction generally parallel to said longitudinal axis of the roll; and sliding said first ram and said second ram within said first cylinder and said second cylinder, respectively, dependent on a weight of each of the roll and said counter mass, whereby a resultant momentum of the roll and said counter mass is approximately equal to zero.

2. The method of claim 1, wherein said sliding step comprises sliding said first ram at a first velocity and sliding said second ram at a second velocity.

3. The method of claim 1, wherein said sliding step comprises sliding said first ram such that movements of said first ram correspond to a sinusoidal velocity profile curve of said roll.

4. In a paper-making machine, a roll shake connected to a roll, the roll being movable in a direction generally parallel to a longitudinal axis of the roll, the improvement wherein said roll shake comprises:

a first hydraulic ram assembly, including a first cylinder and a first ram reciprocally disposed in said first cylinder, said first ram attached to the roll;

a second hydraulic ram assembly, including a second cylinder and a second ram reciprocally disposed in said second cylinder, said second cylinder being rigidly connected to said first cylinder;

a counter mass connected to said second ram, said counter mass movable in a direction generally parallel to the roll axis; and means, connected to said first hydraulic ram assembly and said second hydraulic ram assembly, for independently controlling reciprocating movements of said first ram and said second ram within said first cylinder and said second cylinder, respectively, whereby a resultant momentum of the roll and said counter mass is approximately equal to zero at any point in time.

5. The paper-making machine of claim 1, wherein said counter mass has a different weight than the roll, said controlling means controls said reciprocating movements such that said first ram travels at a different velocity than said second ram, thereby effecting said resultant zero momentum between the roll and said counter mass.

6. The paper-making machine of claim 1, further comprising a sensor connected to said controlling means and at least one of said first cylinder and said second cylinder, said sensor being constructed so as to detect a force applied thereto in a direction generally parallel to the roll axis.

7. The paper-making machine of claim 1, wherein said sensor comprises a load cell.

8. The paper-making machine of claim 1, further comprising a fiberglass mounting connecting said counter mass to an immovable surface, said fiberglass mounting allowing said counter mass to move in said direction parallel to the roll axis.

9. The paper-making machine of claim 1, further comprising a pair of displacement transducers respectively attached to said first hydraulic ram and said second hydraulic ram, each of said displacement transducers being connected to said controlling means and providing a plurality of signals to said controlling means indicative of said reciprocating movements.

10. The paper-making machine of claim 6, wherein each of said displacement transducers comprises an inductive proximity sensor.

11. The paper-making machine of claim 1, wherein each of said first and second hydraulic ram assemblies comprise two-way hydraulic ram assemblies.

12. The paper-making machine of claim 1, wherein said controlling means comprises a hydraulic pumping station connected to each of said first hydraulic ram assembly and said second hydraulic ram assembly, and a microprocessor for independently controlling a flow of hydraulic fluid between said pumping station and each of said first hydraulic ram assembly and said second hydraulic ram assembly.

13. The paper-making machine of claim 12, wherein said controlling means further comprises a pair of servo-valves respectively interconnecting said first hydraulic ram assembly and said second hydraulic ram assembly with said pumping station, each said servo-valve effecting a two-way flow of hydraulic fluid between said pumping station and a respective said first hydraulic ram assembly and said second hydraulic ram assembly, said microprocessor being connected to each of said servo-valves.

14. The paper-making machine of claim 13, further comprising:

a pair of displacement transducers respectively attached to said first hydraulic ram and said second hydraulic ram, each of said displacement transducers being connected to said microprocessor and providing a plurality of signals to said microprocessor indicative of said reciprocating movements; and a load cell connected to said microprocessor and at least one of said first cylinder and said second cylinder, said load cell detecting a force applied thereto in a direction generally parallel to the roll axis and providing a plurality of signals to said microprocessor indicative of said detected force;

said microprocessor controlling said reciprocating movements of said first ram and said second ram, dependent on said plurality of signals provided by each of said displacement transducers and said load cell.

15. The paper-making machine of claim 1, wherein said reciprocating movements of said first ram and said second ram exhibit a sinusoidal velocity profile curve.

16. The paper-making machine of claim 1, wherein said reciprocating movements of said first ram and said second ram exhibit a ramp function velocity profile curve.

17. The paper-making machine of claim 1, wherein said first ram assembly and said second ram assembly are disposed generally coaxial to each other.

18. The paper-making machine of claim 1, wherein said roll comprises a breast roll.

19. In a paper-making machine, a roll shake connect to a roll, the roll being movable in a direction generally parallel to a longitudinal axis of the roll, the improvement wherein said roll shake comprises:

a hydraulic ram assembly including a cylinder and a ram reciprocally disposed in said cylinder, said ram attached to the roll; and means, connected to said hydraulic ram assembly, for controlling reciprocating movements of said ram within said cylinder, whereby movements of said ram result in a selected one of a plurality of velocity profile curves for said roll.

20. In a paper-making machine, a roll shake connect to a roll, the roll being movable in a direction generally parallel to a longitudinal axis of the roll and carrying a web onto which is deposited a fiber suspension, the improvement wherein said roll shake comprises:

a first hydraulic ram assembly, including a first cylinder and a first ram reciprocally disposed in said first cylinder, said first ram attached to the roll;

a second hydraulic ram assembly, including a second cylinder and a second ram reciprocally disposed in said second cylinder, said second cylinder being rigidly connected to said first cylinder;

a counter mass connected to said second ram, said counter mass movable in a direction generally parallel to said longitudinal axis of the roll;

sensor means, connected to at least one of said first cylinder and said second cylinder, for detecting forces applied to said first cylinder in a direction generally parallel to the roll axis; and means, connected to said second hydraulic ram assembly and said sensor means, for controlling reciprocating movements of said second ram within said second cylinder, dependent on said detected forces.

21. The paper-making machine of claim 20, wherein said detected forces are a function of both a weight of the roll and a weight of the fiber suspension.

22. The paper-making machine of claim 20, wherein said sensor means comprises a load cell.

* * * * *

UNITED STATES PATENT AND TRADEMARK OFFICE

CERTIFICATE OF CORRECTION

PATENT NO. : 5,560,808

DATED : October 1, 1996

INVENTOR(S) : Edwin X. Graf

It is certified that error appears in the above-indentified patent and that said Letters Patent is hereby corrected as shown below:

Column 2

Line 8, delete "ill" and substitute --in-- therefor; and line 23, after desired, delete ",".

Column 3

Line 20, delete "side-two-side" and substitute --side-to-side-- therefor.

Column 4

Line 3, delete "rata" and substitute --ram-- therefor.

Column 6

Line 44, delete "6" and substitute --9-- therefor.

UNITED STATES PATENT AND TRADEMARK OFFICE

CERTIFICATE OF CORRECTION

PATENT NO. : 5,560,808

DATED : October 1, 1996

INVENTOR(S) : Edwin X. Graf

It is certified that error appears in the above-indentified patent and that said Letters Patent is hereby corrected as shown below:

Column 7

Line 28, delete "connect" and substitute --connected-- therefor.

Column 8

Line 6, delete "connect" and substitute --connected-- therefor.

Signed and Sealed this

Twenty-fourth Day of December, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,560,808

DATED : October 1, 1996

INVENTOR(S) : Edwin X. Graf

It is certified that error appears in the above-identified patent and that said Letters Patent is hereby corrected as shown below:

COLUMN 6

Line 20, claim 5, delete "1" and insert --4--;

Line 26, claim 6, delete "1" and insert --4--;

Line 31, claim 7, delete "1" and insert --4--;

Line 33, claim 8, delete "1" and insert --4--;

Line 37, claim 9, delete "1" and insert --4--;

Line 44, claim 10, delete "6" and insert --9--;

Line 47, claim 11, delete "1" and insert --4--; and

Line 50, claim 12, delete "1" and insert --4--.

COLUMN 7

Line 17, claim 15, delete "1" and insert --4--;

Line 20, claim 16, delete "1" and insert --4--;

Line 23, claim 17, delete "1" and insert --4--; and

Line 26, claim 18, delete "1" and insert --4--.

Signed and Sealed this

Twenty-first Day of July, 1998

Bruce Lehman

*Attest:*

BRUCE LEHMAN

*Attesting Officer*

*Commissioner of Patents and Trademarks*